US005567487A

United States Patent [19]

Head

[11] Patent Number: 5,567,487

[45] Date of Patent: Oct. 22, 1996

[54] MOVING ART FORM AND METHOD OF PRODUCING SAME

[76] Inventor: Richard M. Head, 12000 N. 90th St., Apt. 3048, Scottsdale, Ariz. 85260

[21] Appl. No.: 396,709

[22] Filed: Mar. 1, 1995

[51] Int. Cl.[6] ..... B43L 9/00

[52] U.S. Cl. ..... 428/14; 428/30; 428/542.2

[58] Field of Search ..... 428/14, 30, 542.2

[56] References Cited

U.S. PATENT DOCUMENTS 1,561,149 11/1925 Gage ..... 428/31 X
2,483,744 10/1949 Vernon ..... 428/14
3,589,045 6/1971 Rakowsky ..... 428/30 X
4,789,573 12/1988 Jenkinson ..... 428/30 X
4,885,193 12/1989 Head ..... 428/14

*Primary Examiner*—Henry F. Epstein
*Attorney, Agent, or Firm*—Richard R. Mybeck

[57] ABSTRACT

A new art form providing a plurality of optical images and illusions by the novel coaction of at least two diverse line and curve patterns disposed in spaced generally parallel relationship to each other, at least one of said patterns being rotatable at a rate different from that of the other pattern. The differential rates of rotation generate a dynamic composite image which is ultimately cyclically repetitive. The art form is especially useful in creating time pieces and mood altering displays for psychological counseling.

20 Claims, 2 Drawing Sheets

MOVING ART FORM AND METHOD OF PRODUCING SAME

The present invention relates generally to the creation and display of a new and dynamic art form and more particularly to an art form in which dissimilar designs and patterns are inscribed on one or more transparencies or on a transparency and one non-transparent base which patterns are then superposed one to the other and at least one of the patterns is rotated relative to the other to create an interesting and unusual constantly changing dynamic image and provide a unique visual effect.

BACKGROUND OF THIS INVENTION

The creation and display of new images and art forms has been the goal of artists since the beginning of man. Even early cave dwellers drew, painted, carved or sculpted images of animals and other representations of their environment, sometimes on the walls of their caves. Some of the images generated by these artists even incorporated the nodes occurring on the rocks or the veins and cracks disposed therein into their sketches and drawings.

Early man also used sticks, stones, berries and like portions of their surroundings to give form and color to their drawings. At each age through history, artists saw the possibilities of new discoveries and tools for the advancement of artistic expression, and through such advancement, the concomitant advancement of the human spirit or soul.

Other art forms involve the congruous or incongruous arrangement of similar or dissimilar objects and things in a familiar or unfamiliar setting to produce an attention-getting and hopefully pleasing visual effect. Of course art, like beauty is in the eye of the beholder.

One recent example of such a mixture of objects to create an interesting visual effect is Picasso's "Bull's Head" (1943) which comprises a bronze cast of various bicycle parts in which the seat is used to suggest the animal's face and the handle bar suggests the animal's horns.

With the advent of the computer, ever new challenges have arisen from the ability to quickly create mathematical representations which heretofore could only be manually plotted after hours of meticulous labor. One such phenomenon is the so-called "moire pattern".

As is well known, the "Moire pattern" is an interference phenomena caused by the interaction of multiple images. Moire pattern generation has been discussed for a long time, e.g., *Scientific American*, May 1963 which described the use of such patterns in a variety of applications from measuring instruments to patterned fabric.

In one prior patent (U.S. Pat. No. 3,589,045) Rakowsky teaches the use of identical images spatially separated from each other while visually aligned so that the pattern created thereby will vary depending on the angle from which it is viewed.

More recently, Head (U.S. Patent No. 4,885,193) created a new art form which provides a plurality of optical images and illusions by the novel coaction of at least two diverse line and curve patterns disposed in spaced generally parallel relationship to each other.

However, in our modern high-tech society, there is a growing fascination with abstract and mathematical graphics and a need for an art form which depicts action in the terms of the scientific age. It is believed that the present invention fulfills that need by providing dynamic, constantly changing images and illusions implemented by a motor driven device operatively associated with at least one of a spaced plurality of patterned transparencies or a transparency and a separate non-transparent image so that the relationship between the moving pattern and another moving or static transparency or non-transparent pattern creates a dynamic, constantly changing visual illusion to the observer.

BRIEF SUMMARY OF THE INVENTION

The present invention relates to a new art form which includes the utilization of a plurality of mathematically defined patterns, disposed in dual or multiple layers, with or without spatial separation between adjacent layers as in Head, supra, and which further involves at least one rotating pattern relative to either other moving or stationary patterns and coacts therewith to create a dynamic composite image. The composite image produced may be easily changed by pattern substitution, color application, or lighting modification.

The dynamic images of the present invention are created by mounting one or more transparent patterns in spaced juxtaposition with and rotating each pattern relative to a dissimilar opaque or transparent pattern or etching which is spatially separated therefrom. The patterns coact to produce interference lines of differing intensities which in turn creates a composite visual image which will constantly change as the transparency is rotated about an axis extending generally perpendicular between the transparency and the base pattern.

The family of curves which are now available by computer generation will, when one is displayed in dynamic juxtaposition with another in accordance herewith, create a myriad of interesting and visually pleasing optical effects.

The creation and positioning of one geometric pattern relative to another and rotating one pattern relative to the other at a substantially uniform rate, as will appear, forms the basis for the present invention. The display formed by assembling various patterns in accordance herewith, as in a clock, for example, provide a unique, fascinating, and highly attractive object which contains high levels of both charm and utility.

Furthermore, other interesting visual effects may be obtained by the use of various colors, either in the background and/or in the lines forming the image, and through the use of appropriate interior or exterior lighting in association with the finished art work.

A further and unexpected advantage of the present invention is realized when it is utilized in connection with psychological counseling where the moving pattern created hereby has been found by several mental health professionals to have a profound effect in inducing an "alpha mode" condition in patients who are seeking help in dealing with past and present stress in their lives.

Accordingly, it is a primary object of the present invention to provide a novel and unique dynamic art form which produces a special "conversation piece" without incurring either the expense or the expertise of a professional artist.

Another object is to provide a novel and unique art form that mental health professionals find extremely beneficial in enhancing their ability to place patients into the alpha mode that is so vital in many of their treatments.

A further object of the present invention is to provide a novel and unique, dynamic art form which utilizes the movement of one or more geometric patterns relative to a static pattern to complement and enhance a given decor and create a special spot of interest.

Still a further object of the present invention is to provide a dynamic art form which can be readily incorporated into a clock to utilize the inherent hand movement of the clock to rotate overlaying patterns relative to a static pattern imposed on the face thereof thereby creating special visual effects.

Still another object of the present invention is to provide a novel and unique dynamic art form and method of practicing the same which results in an eye-catching and attractive decorative and useful wall decoration.

These and still further objects as shall hereinafter appear are readily fulfilled by the present invention in a remarkably unexpected manner as will be readily discerned from the following detailed description of an exemplary embodiment thereof, especially when read in conjunction with the accompanying drawings in which like parts bear like numerals throughout the several views.

DESCRIPTION OF THE PREFERRED EMBODIMENT

Figure 1:
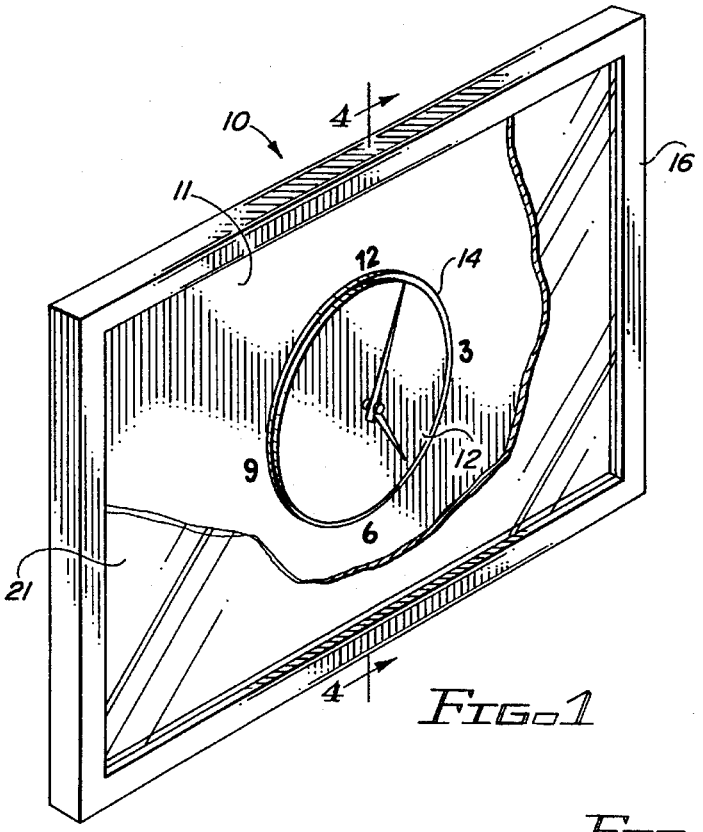
FIG. 1 is an isometric view of one embodiment of the present invention in association with a clock.

The present invention provides a new dynamic art form which is especially useful but not limited to its incorporation into a time keeping device, identified by general reference 10 in the drawings. This new art form is especially appealing because of its ability to provide the viewer an almost infinite variety of different, dynamic images, depending on the viewer's movement and duration of inspection; the disparity of the line or curve patterns employed; the almost endless choice of primary or secondary patterns which can be used; and the virtually infinite variety of spatial and angular relationships which can be established between adjacent patterns.

Figure 3A:
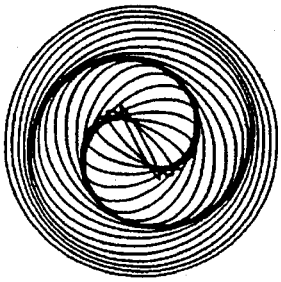
FIGS. 3A–D illustrate some of the variety of geometric patterns which can be employed in the practice of the present invention.
Figure 3B:
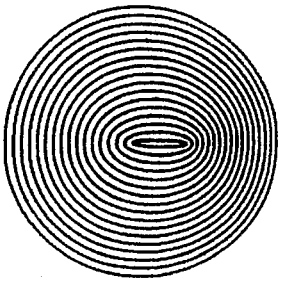
Figure 3C:
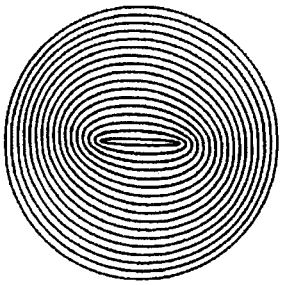
Figure 3D:
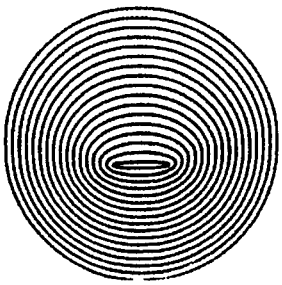

In one practice of the present invention as shown in FIG. 1, a first pattern 11 and a second pattern 12 are selected from the myriad of available patterns, for instance, the patterns shown in FIGS. 3B and 3C.

One of the patterns, for instance pattern 11, is drawn, projected or printed upon an opaque sheet 13 of suitable material while pattern 12 is drawn or printed upon a transparency 14. As shown in FIG. 1, sheet 13 is mounted to a suitable support surface 15 such as the face of time keeping device 10 (usually referred to as a "clock"). In a preferred practice pattern 11, will be applied to opaque sheet 13 while pattern 12 is disposed upon transparency 14, either manually or by use of a computer printer which is programmed to convert mathematical equations into visual representations thereof.

One pattern, for instance pattern 11 is drawn, printed or otherwise deposited on opaque sheet 13 while pattern 12 is drawn, or otherwise deposited on a transparent sheet 14. Opaque sheet 13 is then mounted to a support surface 15 such as the face of clock 10 while transparency 14 is mounted in operative association with one of the hands of the clock as will hereinafter be described in detail.

Transparent sheet 14, usually called "transparencies" may be formed of MYLAR® or like plastic sheeting characterized by both its transparency and its dimensional stability.

The color of the ink for the several patterns is optional to the artist and a wide variety of colors are available in the so-called India ink formulations or in jet printers. It should also be noted that each pattern can be inscribed in the same or a different color ink, attention being given to the ultimate effect desired and the prevalent decorator colors employed in the area in which it will be displayed. Either complementary or contrasting colors are appropriate for use herewith.

Figure 4:
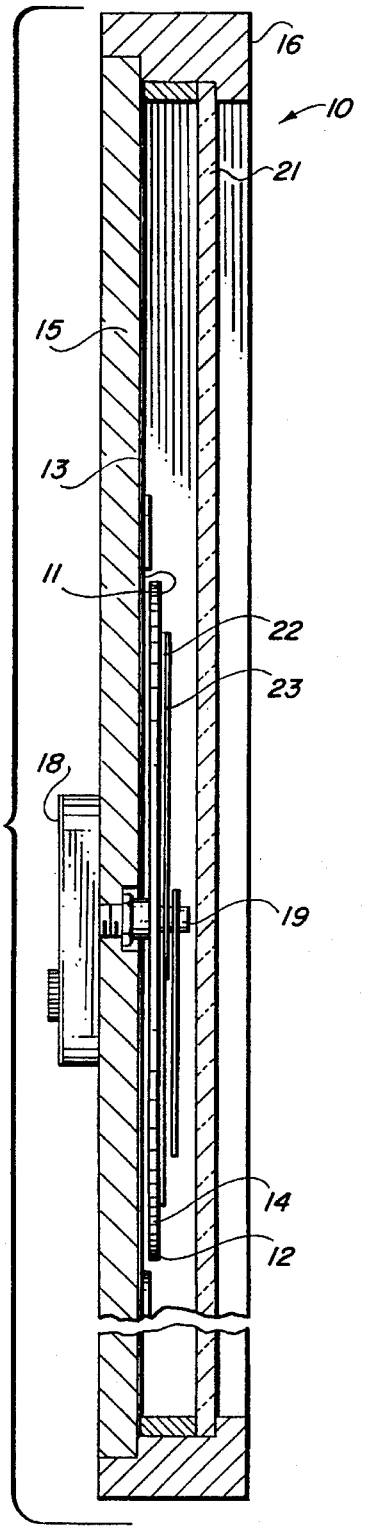
FIG. 4 is a side elevation, partially in cross section, of a power assembly for rotating one or more images in relation to a stationary image in accordance with the present invention.

As shown in FIGS. 1 and 4, once opaque sheet 13 and one or more transparencies 14 of comparable size have been prepared, they are assembled to create an artistic time keeping device 10 embodying the present invention in the following fashion.

Figure 2A:
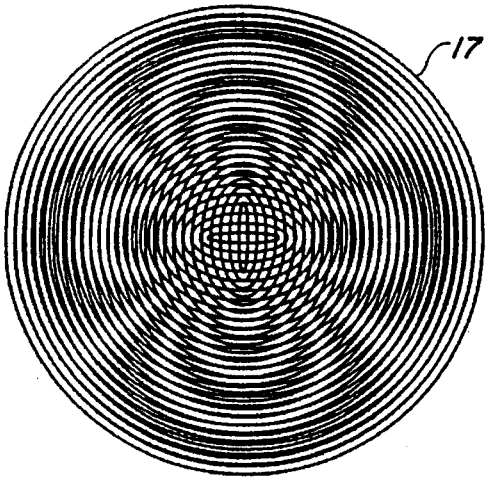
FIGS. 2A and 2B are front elevation views of images created when the same multiple patterns of the present invention are viewed at two different frozen moments in time.
Figure 2B:
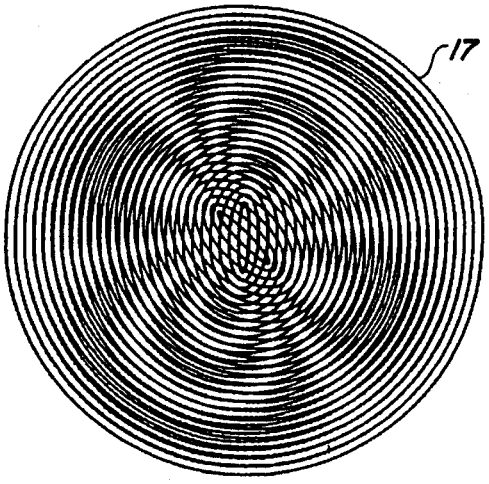

Device 10 is created by mounting opaque sheet 13 upon which, a suitable pattern such, for example, a pattern shown in FIGS. 3A–3D has been mounted or otherwise defined in the rear of a shadow box frame 16. A conventional rotating motor 18, which may be either electric (AC or DC) or spring driven, is mounted to the rear of shadow box frame 16 as shown in FIG. 4. Motor 18 includes a central drive shaft 19 which extends outwardly therefrom through and in perpendicular relationship to surface 15. Shaft 19 is adapted to support transparent sheet 14 upon which a second suitable pattern 12, such for example, as another of the patterns shown in FIGS. 3A–3D has been imprinted. To create the special art form image 17 as shown in FIGS. 2A and 2B and which exemplifies the present invention, backing sheet 13 is mounted on support surface 15 and transparent sheet 14, in this embodiment is mounted on rotatable shaft 19 in spaced (circa 5 mm) generally parallel relationship to backing sheet 13. A solid line (not shown) may be imprinted upon sheet 14 as a radius extending from shaft 19 to the outer perimeter thereof and can be set to rotate therewith at any desired rate, for example, the rate of one revolution per minute thereby simulating a second hand of a clock. In preferred use, sheets 13, 14 will be disposed behind a pane 21 of transparent rigid scratch resistant material such as glass which encloses box frame 16 and encases the device 10 and keeps it dust free.

By faithfully following the foregoing procedure, an artistic clock display 10 as shown in FIG. 1, is created wherein the described interrelationship between patterns 11 and 12 creates a dynamic moving image 17 as illustrated in FIGS. 2A and 2B.

In another embodiment of the present invention, twelve hours of non-precisely-repeating artistic visual patterns can be produced by utilizing an additional transparency 22 having another pattern 23 imprinted thereupon in the manner described and mounting transparency 22 in spaced (circa 5 mm) generally parallel relationship to transparency 14. A solid line similar to the optional radius line on sheet 14 is then imposed on transparency 22 which in coaction with motor 18 is adjusted to rotate at a preselected rate for example, the rate of one revolution per minute. When desired, motor 18 may be adjusted to rotate transparency 22 at the rate of one revolution per hour and to rotate transparency 14 at the rate of one revolution per twelve hours using a conventional multi-drive motor.

It is of course understood that each combination of patterns chosen for display within device 10 will produce its own special image having its own unique visual effect. Ultimately, these images will cyclically repeat depending upon the rotation rates selected.

Figure 5:
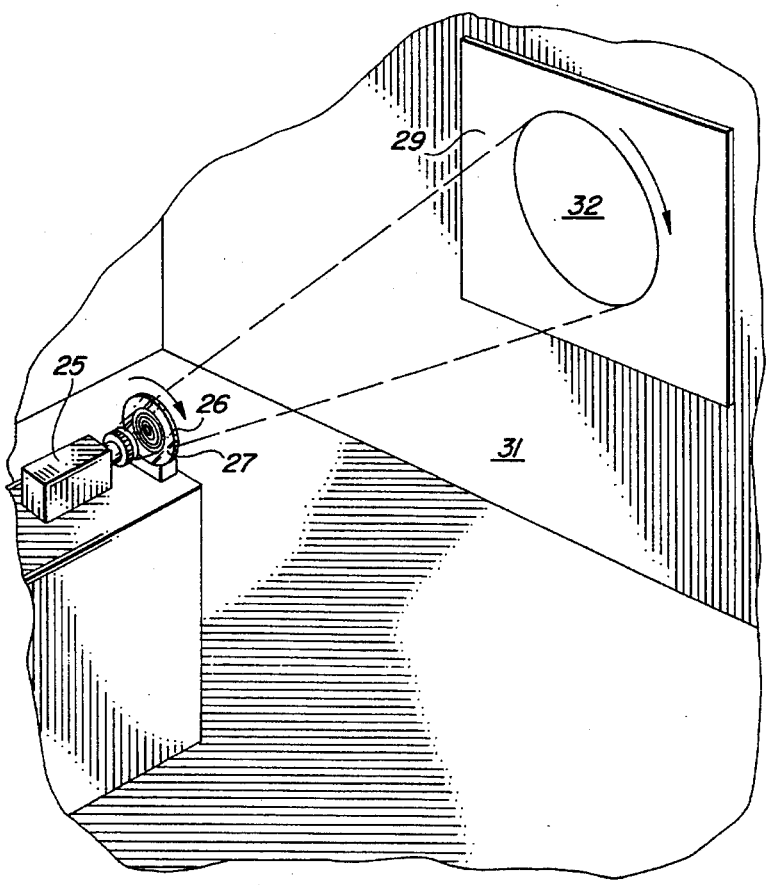
FIG. 5 is an isometric schematic view of an alternative embodiment of the present invention in which the dynamic image is created on a stationary image disposed on a vertical wall.

In still another practice of the present invention in which the dynamic image is created upon a wall as shown in FIG. 5, the embodiment comprises a conventional film projector 25, arranged to project light through pattern 26 imprinted upon a transparency 27 mounted at the front of projector 25 and rotatable relative thereto. A second distinct pattern 29, mounted or otherwise displayed upon a wall 31 and positioned to interact with projected image of rotating pattern 26. Transparency 27 is arranged to rotate at a preselected rate such as one revolution per minute while pattern 29 remains stationery and a dynamically changing composite image 32 is generated. This arrangement has been found especially useful by psychiatric practitioners who wish to import an alpha mode in distressed patients.

The visual effect, when studied by a person focused upon the pattern in a serene environment, has been reported to be extremely successful in inducing the "alpha mode" in patients seeking help in dealing with past and present stress in their lives.

In another variation, device 10 may be back lighted using conventional low intensity circuitry which will enable device 10 to be observed even when mounted in a dark room although conventional ambient and front lighting is equally attractive. Also, if desired, the images and transparencies can be created to respond to so called "black light" and provide still another effect.

Among the various patterns which have been created pursuant hereto and found to produce highly satisfactory results are the ellipses which, if concentric, as shown in FIG. 3, are prepared according to the equation:

$$x=a \cos N$$

$$y=b \sin N$$

wherein:

a and b are constants for a given ellipse;

N varies from $0 \rightarrow 2\pi$ in small steps equal to: $\Delta N \approx 0.01$ to provide a generally smooth curve. In a preferred practice, a and b will be incremented in small steps $\Delta a$ and/or $\Delta b$ such the space between consecutive ellipses will always be within a factor of 1–5 times the width of the line generating the ellipses.

For non-concentric ellipses, also shown in FIG. 3, the equation is:

$$x=01+a \cos N$$

$$y=b \sin N$$

which is the same as for the concentric ellipses except that the center of each successive ellipse is moved by a small increment $\Delta O_1$, along the x-axis, in either the positive or negative X-direction.

Another form of non-concentric ellipses, also shown in FIG. 3 is obtained using the equations:

$$x=a \cos N$$

and $$y=02+b \sin N$$

wherein:

a and b are constant for a given ellipse and

N varies from 0 to $2\pi$ with a $\Delta N \approx 0.01$ as before except that here the center is moved by a small increment, $\Delta O_2$, along the y-axis, in either the positive or negative y-direction.

Still another form of non-concentric ellipse is obtained using the equations:

$$x_1=01+a \cos N$$

and $$y_1=02+b \sin N$$

wherein:

a and b are constant for a given ellipse and N varies from 0 to $2\pi$ with a $\Delta N \approx 0.01$ as before except that the center of each successive ellipse is moved in the combined directions given by $\Delta O_1$ $\Delta O_2$.

Other patterns found to provide interesting and attractive results when used with the present invention include concentric ellipses having the major axes oriented at a constant angel G relative to the x-axis so that $$x_1 = a\cos N \qquad x = x_1 \cos G - y_1 \sin G$$

$$y_1 = b\sin N \quad \& \quad y = y_1 \cos G + x_1 \sin G$$

or $$x = a\cos N\cos G - b\sin N\sin G \qquad y = b\sin N\cos G + a\cos N\sin G$$

which can be further varied by rotating the axes of each successive ellipse through an incremental angle AG as shown in FIG. 6.

Another useful figure in the practice of the present invention is the hyperbola (not shown) which is derived by the formulae:

$$x = a/2\,(e^L + e^{-L}) \qquad \text{or} \qquad X^2/a^2 - Y^2/b^2 = 1$$

$$y = b/2\,(e^L - e^{-L})$$

Successive hyperbolae are generated by incrementing a and b in small steps $\Delta a$ and $\Delta b$, where $\Delta a$ can be less than, equal to, or greater than $\Delta b$. L is a constant. Similarly the origin can be translated and/or the axes can be rotated as described above.

Sine waves (not shown), oriented in the x-direction, are produced by the equation:

$$y=c \sin [-2\pi(x+a)/(4a/3)]$$

Cosine waves (not shown), oriented in the y-direction, are created by the equation:

$$x=c \cos [\pi(y-b)/b]$$

As will further appear, the present invention is especially useful for, but not limited to the production of artistic time keeping devices with which white or colored internal or external lighting can be used to vary the principal visual effect obtained therefrom. It will be further noted that the several pattern lines may be formed in a variety of preselected colors and the background can be likewise created in various colors which are either complementary to or contrasting with each other.

From the foregoing, it is readily apparent that a new art form and method of producing the same has been herein described and illustrated which fulfills all of the aforestated objectives in a remarkably unexpected fashion. It is of course understood that such modifications, alterations and adaptations as may readily occur to the artisan confronted with this disclosure are intended within the spirit of the present invention which is limited only by the scope of the claims appended hereto.

Accordingly, what is claimed is:

1. A new art form comprising a backing sheet having a first precisely generated planar pattern imposed thereupon; a first transparent sheet having a second precisely generated planar pattern imposed thereupon, said second planar pattern being discernibly different from said first planar pattern, said first transparent sheet being disposed in fixed planar relationship to said backing sheet and rotatable relative thereto to create a dynamic optical effect therewith.

2. A new art form according to claim 1 in which said transparent sheet is disposed in substantially parallel spaced relationship to said backing sheet.

3. A new art form according to claim 2 in which said backing sheet and said transparent sheet are mounted in a shadow box frame.

4. A new art form according to claim 1 in which said first pattern comprises a geometrically generated pattern based on a generally recognized mathematical formulae.

5. A new art form according to claim 4 in which said mathematical formulae is selected from the group consisting of the formulae for concentric ellipses, non-concentric ellipses, hyperbolae, sine waves, cosine waves, circles and straight lines.

6. A new art form according to claim 5 in which said second pattern comprises a geometrically generated pattern based on one of the generally recognized mathematical formulae.

7. A new art form according to claim 6 in which said transparent sheet is disposed in substantially parallel spaced relationship to said backing sheet.

8. A new art form according to claim 7 in which said backing sheet and said transparent sheet are mounted in a shadow box frame.

9. A new art form according to claim 1 in which said second pattern comprises a geometrically generated pattern based on one of the generally recognized mathematical formulae.

10. A new art form according to claim 9 in which said mathematical formulae is selected from the group consisting of the formulae for concentric ellipses, non-concentric ellipses, hyperbolae, sine waves, cosine waves, circles, and straight lines.

11. A new art form according to claim 10 in which said backing sheet and said transparent sheet are mounted in a shadow box frame.

12. A new art form according to claim 1 in which said backing sheet and said transparent sheet are mounted in a shadow box frame.

13. A new art form according to claim 1 having a second transparent sheet having a third pattern imposed thereupon disposed in fixed spaced relationship relative to said backing sheet and said first transparent sheet and rotatable at a speed different from the speed of rotation of said first transparent sheet.

14. A new art form according to claim 13 in which said third pattern comprises randomly generated lines.

15. A new art form according to claim 14 in which said third pattern comprises a geometrically generated pattern based on one of the generally recognized mathematical formulae.

16. A new art form according to claim 15 in which said mathematical formula is selected from the group consisting of the formulae for concentric ellipses, non-concentric ellipses, hyperbolae, sine waves, cosine waves, circles and straight lines.

17. A new art form comprising a first precisely generated planar pattern imprinted upon a transparency and projectable upon a common surface to create a first image, a second precisely generated planar pattern independently disposed upon said common surface to create a second image, said first image being rotatable at a rate different than that of said second image and coacting therewith to create a dynamic composite image.

18. A new art form according to claim 17 in which said second image is static.

19. A new art form according to claim 18 in which said patterns are geometrically generated based on one of the generally recognized mathematical formulae.

20. A new art form according to claim 19 in which said mathematical formula is selected from the group consisting of the formulae for concentric ellipses, non-concentric ellipses, hyperbolae, sine waves, cosine waves, circles and straight lines.

* * * * *